United States Patent [19]

Plumb

[11] 4,322,252

[45] Mar. 30, 1982

[54] LABEL REMOVAL FROM PHONOGRAPH RECORD DISKS

[76] Inventor: Robert C. Plumb, 218 Farm Rd., Marlboro, Mass. 01752

[21] Appl. No.: 161,025

[22] Filed: Jun. 19, 1980

[51] Int. Cl.[3] ..... B08B 3/08; B08B 7/04

[52] U.S. Cl. ..... 134/12; 15/302; 134/25.4; 134/30; 134/65; 134/105

[58] Field of Search ..... 134/31, 11, 12, 25.4, 134/30, 65, 104, 105, 132, 109; 15/302; 202/170

[56] References Cited

U.S. PATENT DOCUMENTS

| | | | |
|---|---|---|---|
| 564,398 | 7/1896 | Templeton | 134/11 |
| 2,089,102 | 8/1937 | Savage | 134/11 X |
| 2,854,360 | 9/1958 | Pajes | 134/30 |
| 3,196,772 | 7/1965 | Sickles | 134/65 |
| 3,857,983 | 12/1974 | Roth | 134/31 X |
| 4,191,201 | 3/1980 | Barnsbee | 134/104 |

*Primary Examiner*—Richard V. Fisher

*Attorney, Agent, or Firm*—Gerry A. Blodgett; Norman S. Blodgett

[57] ABSTRACT

Method and apparatus for removing labels from an article such as a phonograph record, consisting of subjecting the article and label to the action of a solvent in a vapor-phase mode, and a liquid phase mode, passing the article through a drying space and subjecting the article to a blast of compressed air to blow off the label.

9 Claims, 2 Drawing Figures

Fig. 1
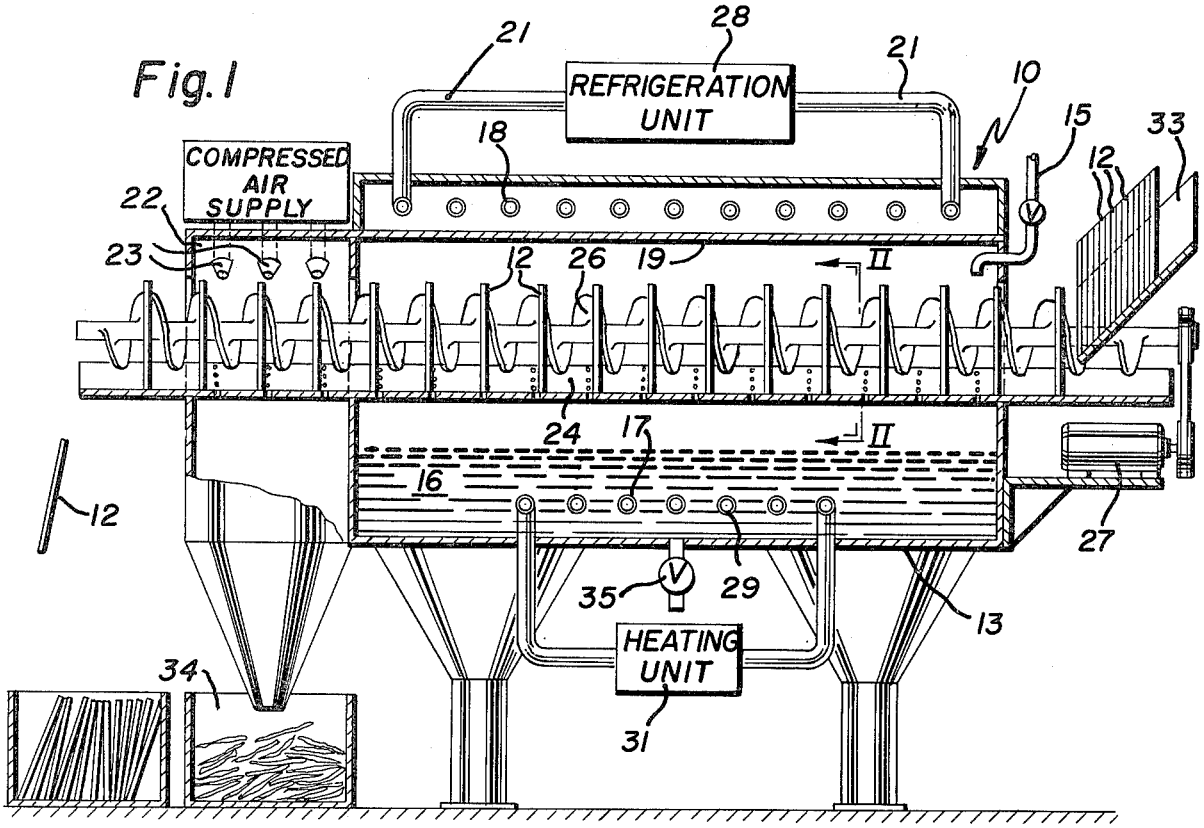
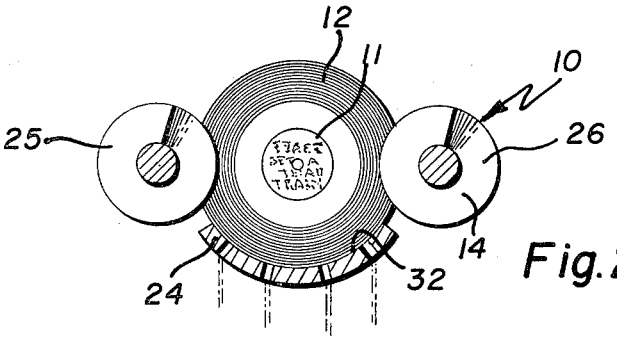
Fig. 2

LABEL REMOVAL FROM PHONOGRAPH RECORD DISKS

BACKGROUND OF THE INVENTION

One of the small problems of modern life is the removal of labels from articles, so that these articles can be re-cycled. The usual reason for desiring to do this lies in the fact that the article contains valuable materials that can be salvaged. In other cases, it is profitable to re-use the article because its manufacture from the raw material is energy or labor intensive. This interesting problem is encountered in the case of phonograph records which are made of valuable plastic, such as polystyrene. A considerable number of these records are available for two reasons: first of all, the record companies over-produce a given recording, since this is more cost-effective for them than making a second batch if the record is successful. Secondly, there is a relatively untapped source of plastic in used records. The plastic in records, incidentally, is particularly expensive, since it is a special formulation.

Attempts to capitalize on this available supply of plastic that could be re-cycled have been less than successful in the past. The recycled plastic is contaminated with about 3 wt. % paper if the record is granulated without removing the paper and this greatly reduces the quality of the material. The center of the record can be stamped out, with the label, and discarded but this process wastes 30% of the plastic. These and other difficulties experienced with the prior art methods and apparatus have been obviated in a novel manner by the present invention.

It is, therefore, an outstanding object of the invention to provide apparatus for removing labels from articles, which apparatus makes use of a solvent in vapor-phase condition.

Another object of this invention is the provision of label-removing apparatus that requires little manual labor.

A further object of the present invention is the provision of apparatus for removing labels, in which solvent fumes are not released into the work area.

It is another object of the instant invention to provide label-removing system in which the labels are maintained separate from the body of solvent.

A still further object of the invention is the provision of label-removing system in which the labels are subjected to solvent which is not contaminated with adhesive.

SUMMARY OF THE INVENTION

In general, the invention consists of apparatus for removing paper labels from phonograph record disks. The apparatus includes a reactor through which extends a horizontal conveyor carrying the disks. Means is provided for introducing an adhesive solvent into the housing, so that it forms a pool in the bottom of the housing under the conveyor. A heater contacts the solvent, so that it forms a vapor that passes upwardly around the disks as they move through the housing. Means is provided for condensing the vapor above the conveyor, so that the condensate falls downwardly around the disks into the pool.

More specifically, a preheat chamber and a draining chamber form part of the reactor and air nozzles are directed toward the disks as the conveyor carries them from the draining chamber after treatment with the solvent. The conveyor consists of a set of two screws of the correct pitch and lead, and rotating at the correct frequency, to provide the disks with the proper exposure to solvent.

BRIEF DESCRIPTION OF THE DRAWINGS

FIG. 1 is a side elevational view of apparatus embodying the principles of the present invention, with portions broken away, and FIG. 2 is a fragmentary vertical cross-sectional view of the apparatus, taken along line II—II of FIG. 1.

DESCRIPTION OF THE PREFERRED EMBODIMENT

Referring first to FIG. 1, which best shows the general features of the invention, the apparatus, indicated generally by the reference numeral 10, is shown in use removing labels 11 from phonograph record disks 12. A box-like housing 13 is suitably mounted on legs at an appropriate work level. A conveyor 14 extends horizontally through the housing and carries the disks one-by-one through it. Means, such as a valved conduit 15, serves to introduce into the housing an adhesive solvent, so that it forms a pool 16 in the bottom of the housing under the conveyor. In the preferred embodiment the solvent is alcohol. A heating means, such as a coil 17, is mounted in the lower portion of the housing in contact with the solvent, so that it forms a vapor that passes upwardly around the disks as they are moved through the housing. A condensing means is located above the conveyor to convert the solvent from its vapor phase to its liquid phase, the condensate falling downwardly onto and around the disks into the pool.

The condensing means comprises an upper horizontal wall 19 overlying the conveyor and a cooling coil 18 located above and close to the upper wall to maintain it at condensing temperature.

The housing is formed with a separate drying room 22 through which the conveyor 14 extends, the conveyor carrying the disks through the drying room after treatment by the solvent vapor and condensate. Air nozzles 23 connected to a source of compressed air are mounted on the walls of the drying room and are directed toward the path of the disks.

As shown in FIG. 2, the conveyor 14 consists of a horizontal trough 24 above which are located two spaced, parallel horizontal screws 25 and 26 which are driven by a motor 27 to move the disks in the horizontal direction and in a vertical aspect.

The cooling coil 18 is operatively connected to a refrigeration unit 28 by a conduit 21, while the heating means 17 consists of a heat exchange coil 29 located in the lower part of the housing in the solvent pool 16 and is connected to a heating unit 31.

The trough 24 is formed with an upwardly-directed curved surface 32 having a cross-sectional shape which is a segment of a circle having approximately the same radius of curvature as a phonograph record disk 12. Suitable apertures are provided for drainage. A feeder 33 is provided at the entrance end of the housing on which record disks can be stacked to introduce the disks 12 one-by-one to the conveyor 14. The drying room 22 is provided with a bottom hopper 34 to receive labels 11 that are removed by the action of the air nozzles 23. The bottom of the housing is provided with a valve 35 to permit removal of solvent when it has become extensively contaminated by adhesive.

The pitch, lead, and rate of rotation of the screws and the length of the reactor are designed to provide proper spacing between records. In a typical embodiment, the screws have a triple thread with a 3/32" pitch and 9/32" lead and rotate at 60 rpm, carrying the records through a 36" long reactor. Liquid and vapor loss is avoided with the entrance and exit baffle chambers, the former serving to preheat the records and prevent vapor loss and the latter serving to provide residence time for complete drainage and to prevent vapor loss. After the records exit from the drain chamber, the labels are blown off by a pulsed jet of compressed air. The adhesive is, typically, a phenol-formaldehyde resin, but the invention is not limited to this adhesive.

The process of removing the labels and the operation of the apparatus will now be readily understood in view of the above description. The disks 12 which are to be treated are placed on the feeder 33 and it acts to place them one-by-one on the conveyor 14. It moves them through the solvent treatment portion of the housing, through the drying room 22, and out at the other end. Each disk rests on the surface 32 of the trough 24 and is carried axially by the action of the screws 25 and 26. As the disk passes over the pool 16, the heating means 17 heats the pool and generates solvent vapor. This vapor passes upwardly around the disks, so that the disk 12 and its label 11 are heated and the adhesive is not only heated, but also chemically attacked. The vapor passes to the upper part of the housing and into contact with the upper wall 19. This wall is continually maintained at a low temperature (below the boiling point of the solvent, i.e., 60° C. for ethanol) by the cooling coil 18, so that the vapor condenses. This provides a pure condensate of solvent that is free of contamination by the adhesive, which impurity would otherwise inhibit the chemical activity of the solvent. The pure condensate falls downwardly and some of it falls on the disk and flows over it. The solvent acts on the adhesive to dissolve it and then falls from the disk into the pool. The pool, thus, contains solvent which becomes successively more contaminated by adhesive. When it reaches a certain degree of contamination, it is drawn off through the valve 35 and new, clean solvent is introduced through the conduit 15.

The conveyor then carries the disks into the drying room 22. The labels still cling to the disks, but most of the adhesive has been removed. The blast of air from the nozzles 23 serve to dry the labels and to blow them off the disk, so that they fall downwardly into the hopper from which they are removed from time to time. By moving the record disks through the solvent room and the drying room in a substantially vertical condition, the labels on both sides can be acted upon simultaneously by the solvent and by the drying air flow.

The advantages of the method and apparatus are evident. The adhesive is acted upon by uncontaminated solvent, so that the dissolving and loosening action takes place in the most efficient manner with the reaction taking place at a very high temperature. The labels do not fall into the pool of solvent and in this way the vaporization of the solvent is not inhibited by the presence of paper. When the entrance and the exit of the housing are suitably sealed, there is very little release of solvent vapor into the atmosphere surrounding the apparatus. The working conditions, therefore, are quite good and the amount of manual labor is relatively small.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. Apparatus for removing labels from phonograph record disks, comprising:

(a) a housing, (b) a conveyor extending horizontally through the housing to carry the disks therethrough, (c) means for introducing an adhesive solvent into the housing so that it forms a pool in the bottom of the housing, (d) heating means contacting the solvent so that it forms a vapor that passes upwardly around the disks as they move through the housing, (e) means for condensing the vapor above the conveyor so that the condensate falls downwardly around the disks into the pool, (f) a drying room forming part of the housing and located downstream of the pool so that the conveyor carries the disks through the drying room after treatment with the solvent, and (g) air nozzles located in the drying room directed toward the disks.

2. Apparatus as recited in claim 1, wherein the condensing means comprises an upper wall overlying the conveyor and a cooling coil located adjacent the upper wall to maintain it at condensing temperature.

3. Apparatus as recited in claim 2, wherein the conveyor consists of two spaced, parallel horizontal screws and a horizontal trough located below and intermediate the screws, the screws being driven to move the disks in the horizontal direction in a vertical condition.

4. The apparatus as recited in claim 3, wherein the cooling coil is operatively connected to a refrigeration unit, wherein the heating means consists of a heat exchange coil located in the lower portion of the housing and connected to a heating unit, and wherein the trough is shaped with an upwardly-directed curved surface having a cross-sectional shape which is a segment of a circle having approximately the same diameter as a disk.

5. Apparatus as recited in claim 4, wherein a feeder is provided to introduce the disks seriatim to the upstream end of the conveyor.

6. Apparatus as recited in claim 5, wherein the drying room is provided with a hopper to receive labels removed by the action of the air nozzles.

7. Process for removing labels from phonograph record disks, comprising the steps of:

(a) passing the disks through an enclosed space, (b) heating a pool of adhesive solvent in the space to cause vapor to pass over the disks, (c) condensing the vapor at the upper part of the space so that the condensate falls downwardly around the disks into the pool, (d) passing the disks through a drying space, and (e) subjecting the disks to a blast of compressed air to blow off the labels.

8. Process as recited in claim 7, wherein the solvent is alcohol, and the disks are passed through the spaces in separated, vertical condition.

9. Process as recited in claim 7, wherein the disks are subjected to a blast of compressed air within the drying space.

* * * * *